US011186462B1

(12) United States Patent
Leger et al.

(10) Patent No.: US 11,186,462 B1
(45) Date of Patent: Nov. 30, 2021

(54) INFLATABLE PIPE DRUM SYSTEMS AND METHODS

(71) Applicant: Trinity Bay Equipment Holdings, LLC, Houston, TX (US)

(72) Inventors: John Paul Leger, Baytown, TX (US); Kraig Tabor, Houston, TX (US); Jagtar Singh Thethy, Cypress, TX (US)

(73) Assignee: Trinity Bay Equipment Holdings, LLC, Houston, TX (US)

( * ) Notice: Subject to any disclaimer, the term of this patent is extended or adjusted under 35 U.S.C. 154(b) by 0 days.

(21) Appl. No.: 17/215,502

(22) Filed: Mar. 29, 2021

(51) Int. Cl.
*B65H 75/42* (2006.01)
*B65H 75/44* (2006.01)

(52) U.S. Cl.
CPC ..... *B65H 75/425* (2013.01); *B65H 75/4449* (2013.01); *B65H 2701/33* (2013.01)

(58) Field of Classification Search
CPC ..... B65H 75/425; B65H 75/4449; B65H 2701/33
See application file for complete search history.

(56) References Cited

U.S. PATENT DOCUMENTS

| | | | | |
|---|---|---|---|---|
| 8,985,496 | B2 * | 3/2015 | Dillinger | B65H 49/30 242/577 |
| 10,654,395 | B1 * | 5/2020 | White | B60P 3/035 |
| 10,941,015 | B1 * | 3/2021 | Matari | B65H 75/22 |
| 2019/0257445 | A1 * | 8/2019 | Case | B65H 75/248 |
| 2020/0039781 | A1 * | 2/2020 | Barnett | E21B 19/008 |

OTHER PUBLICATIONS https://www.woodworkingshop.com/product/ht50000/; Jan. 10, 2019.

* cited by examiner

*Primary Examiner* — Sang K Kim
(74) *Attorney, Agent, or Firm* — Conrad J. Hsu

(57) ABSTRACT

Techniques for implementing and/or operating a pipe drum system that includes a drum body. The drum body is to be disposed within an interior channel of a pipe coil that is formed from a flexible pipe including tubing that defines a pipe bore and a fluid conduit within a tubing annulus. The drum body includes a drum core implemented with substantially fixed dimensions and a fluid bladder layer implemented circumferentially around the drum core. The pipe drum system maintains the fluid bladder layer in a first state to enable the drum body to be inserted into the interior channel of the pipe coil after the pipe coil is formed and increases inflation of the fluid bladder layer from the first state to a second state to enable an outer surface of the drum body to push against an inner surface of the pipe coil to facilitate supporting the pipe coil.

19 Claims, 6 Drawing Sheets

INFLATABLE PIPE DRUM SYSTEMS AND METHODS

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Pipeline systems are often implemented and/or operated to facilitate transporting (e.g., conveying) fluid, such as liquid and/or gas, from a fluid source to a fluid destination. In some embodiments, the pipeline system may include flexible pipe. In particular, in some instances, a flexible pipe may be formed (e.g., wound and/or spooled) into a pipe coil to facilitate storage, transportation, and eventual deployment. However, it may be challenging to support (e.g., maintain) a pipe coil.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one example, a pipe drum system includes a drum body. The drum body is to be disposed within an interior channel of a pipe coil that is formed from a flexible pipe including tubing that defines a pipe bore and a fluid conduit within an annulus of the tubing. The drum body includes a drum core implemented with substantially fixed dimensions and a fluid bladder layer implemented circumferentially around the drum core. The pipe drum system maintains the fluid bladder layer in a first state to enable the drum body to be inserted into the interior channel of the pipe coil after the pipe coil is formed and increases inflation of the fluid bladder layer from the first state to a second state to enable an outer surface of the drum body to push against an inner surface of the pipe coil to facilitate supporting the pipe coil.

In another example, a method of implementing a pipe drum system includes implementing a drum core of a drum body in the pipe drum system that is to be disposed within an interior channel of a pipe coil such that the drum core has substantially fixed dimensions; securing a drum shaft to the drum core of the drum body such that the drum shaft extends out from the drum core, and securing fluid bladders circumferentially around the drum core of the drum body to enable the drum body to be inserted into the interior channel of the pipe coil at least in part by maintaining the plurality of fluid bladders in a deflated state and the drum body to be secured to the pipe coil at least in part by transitioning the plurality of fluid bladders from the deflated state to an inflated state to enable flexible pipe to be deployed from the pipe coil at least in part by rotating the drum body about the drum shaft.

In another example, a drum body includes a drum core implemented to have a substantially fixed geometry, a drum shaft that extends out from the drum core to enable flexible pipe to be deployed from a pipe coil that is secured to the drum body at least in part by rotating the drum body about the drum shaft, and fluid bladders secured circumferentially around the drum core. The fluid bladders contract an outer surface diameter of the drum body inwardly as the fluid bladders are transitioned from an inflated state to a deflated state to enable the drum body to be inserted into an interior channel of the pipe coil and expand the outer surface diameter of the drum body outwardly as the fluid bladders are transitioned from the deflated state to the inflated state to facilitate securing the drum body to the pipe coil.

Other aspects and advantages of the claimed subject matter will be apparent from the following description and the appended claims.

DETAILED DESCRIPTION

Figure 1:
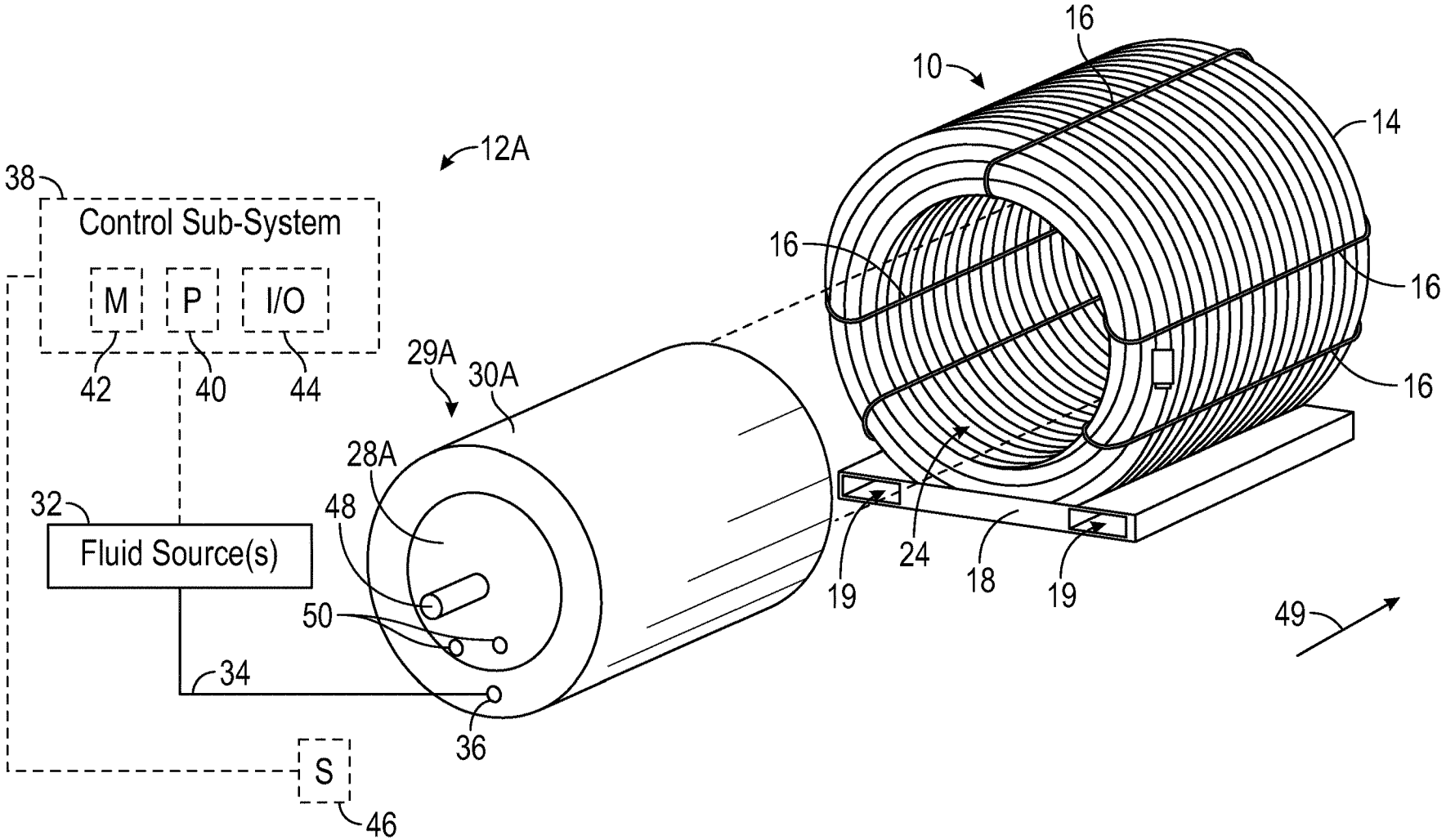
FIG. 1 is a perspective view of an of a pipe coil and an example of a pipe drum system, in accordance with an embodiment of the present disclosure.

Certain embodiments commensurate in scope with the present disclosure are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

As used herein, the term "coupled" or "coupled to" may indicate establishing either a direct or indirect connection, and is not limited to either unless expressly referenced as such. The term "set" may refer to one or more items. Wherever possible, like or identical reference numerals are used in the figures to identify common or the same elements. The figures are not necessarily to scale and certain features and certain views of the figures may be shown exaggerated in scale for purposes of clarification.

Furthermore, when introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

As explained above, in some instances, a flexible pipe may be deployed in a pipeline system. Additionally, as explained above, in some instances, a flexible pipe may be formed (e.g., wound and/or spooled) into a pipe coil with an interior channel. However, as mentioned above, it may be difficult to support a pipe coil formed from a flexible pipe, for example, to block the pipe coil from deflecting (e.g., deforming) inwardly.

To facilitate supporting a pipe coil, the present disclosure provides techniques for implementing and/or operating a pipe drum system that includes a drum body, which can be disposed within the interior channel of the pipe coil. In particular, as will be described in more detail below, the present disclosure provides techniques for implementing and/or operating the pipe drum system to enable the outer surface diameter of the drum body to be adaptively adjusted. To facilitate adaptively adjusting its outer surface diameter, the drum body may include a drum core implemented using rigid material, a drum shaft that extends out from the drum core, and one or more fluid (e.g., air and/or liquid) bladders secured circumferentially around the drum core.

As such, the volumetric size of the one or more fluid (e.g., inflatable) bladders in a drum body and, thus, the outer surface diameter of the drum body may be controlled at least in part by controlling the supply of actuation fluid (e.g., liquid and/or gas) to and/or the extraction of actuation fluid from the one or more fluid bladders. In fact, in some embodiments, different amounts of actuation fluid may be supplied to the one or more fluid bladders in a drum body to enable the drum body to support pipe coils with differing dimensions. Merely as an illustrative non-limiting example, a larger amount of actuation fluid may be supplied to the one or more fluid bladders of the drum body to enable the drum body to support a pipe coil with a larger inner surface diameter whereas a smaller amount of actuation fluid may be supplied to the one or more fluid bladders of the drum body to enable the drum body to support another pipe coil with a smaller inner surface diameter. Moreover, actuation fluid may be extracted from the one or more fluid bladders of the drum body to enable the drum body to be selectively inserted into and/or withdrawn from the interior channel of a pipe coil. In other words, at least in some instances, implementing and/or operating a pipe drum system in accordance with the techniques of the present disclosure may facilitate reducing implementation-associated cost (e.g., component count and/or physical footprint) of a pipe drum system, for example, by enabling the same drum body to be selectively used to support multiple different pipe coils.

To help illustrate, a flexible pipe 10 and an example of a pipe drum system 12A are shown in FIG. 1. Generally, the flexible pipe 10 may include tubing that can be used to facilitate conveying or transferring water, gas, oil, and/or any other suitable type of fluid (e.g., liquid and/or gas). In particular, in some embodiments, the flexible pipe 10 may be made of material including a plastic, a metal, a composite (e.g., a fiber-reinforced composite), and/or another suitable material, for example, to withstand wear, to accommodate a variety of pressures, to shield conveyed fluid from an ambient environment, and/or the like.

Additionally, in some embodiments, the flexible pipe 10 may include a bonded flexible pipe, an unbonded flexible pipe, a flexible composite pipe (FCP), a thermoplastic composite pipe (TCP), a reinforced thermoplastic pipe (RTP), coiled tubing, reeled tubing, or any combination thereof. In other words, in some such embodiments, the flexible pipe 10 may be implemented with multiple layers. For example, the flexible pipe 10 may include an inner barrier (e.g., liner) layer that defines its pipe bore, one or more intermediate (e.g., reinforcement) layers implemented around the liner layer, and an outer barrier (e.g., shield) layer implemented around the one or more intermediate layers.

In particular, in some embodiments, different layers of a flexible pipe 10 may be implemented using different materials. For example, the inner barrier layer and/or the outer barrier layer of the flexible pipe 10 may be implemented using thermoplastic, such as be high density polyethylene (HDPE). On the other hand, an intermediate layer of the flexible pipe 10 may be implemented using a composite material and/or metal, such as such as carbon steel, stainless steel, duplex stainless steel, super duplex stainless steel, or any combination thereof. In fact, in some embodiments, the intermediate layer may be implemented at least in part by helically winding a strip of material (e.g., steel) around another (e.g., inner barrier) layer of the flexible pipe 10, for example, such that gaps are left between adjacent windings of the material to define fluid conduits within an annulus of the tubing of the flexible pipe 10. Although a number of particular layers are described, it should be understood that the techniques described in the present disclosure may be broadly applicable to composite pipe body structures including two or more layers, for example, as distinguished from a rubber or plastic single-layer hose subject to vulcanization.

In any case, as depicted, the flexible pipe 10 is formed (e.g., wound and/or spooled) into a pipe coil 14 with an interior channel 24, for example, during manufacture of the flexible pipe 10. As in the depicted example, in some embodiments, the pipe coil 14 may be disposed on a pipe coil skid (e.g., pallet) 18, for example, which includes forklift channels 19 that enable a forklift to move the pipe coil skid 18. Additionally, as in the depicted example, in some embodiments, one or more straps (e.g., cables) 16 may be secured around the pipe coil 14, for example, to facilitate maintaining the shape of the pipe coil 14 before the pipe drum system 12A is used to support the pipe coil 14.

However, it should be appreciated that the depicted example is merely intended to be illustrative and not limiting. In particular, instead of a pipe coil skid 18, in other embodiments, a pipe coil 14 may be disposed on pipe deployment equipment, such as a pipe deployment trailer, a pipe deployment frame, or a pipe deployment cradle, for example, to enable flexible pipe 10 to be deployed from the pipe deployment equipment into a pipeline system. Additionally or alternatively, in other embodiments, a cable 16 may not be secured around a pipe coil 14, for example, after a pipe drum system 12 is used to support the pipe coil 14.

In any case, to facilitate supporting the pipe coil 14, as depicted, the pipe drum system 12A includes a drum body 29A, which is implemented to be inserted within the interior channel 24 of the pipe coil 14. In particular, as depicted, the drum body 29A includes a drum core 28A, a fluid (e.g., inflatable) bladder 30A implemented circumferentially around the drum core 28A, and a drum shaft 48 that extends out from the drum core 28A in an axial direction 49. In some embodiments, a drum shaft 48 of a drum body 29 may be implemented to interface with a braking assembly on pipe deployment equipment to enable the braking assembly to be used to control rotational speed of the drum body 29 and, thus, deployment speed of flexible pipe 10 resulting from rotation of the drum body 29. Additionally, in some embodiments, a portion of a flexible pipe 10 may be coupled to or engaged with (e.g., tied, mechanically fastened) the drum shaft 48 of a drum body 29 to facilitate securing a corresponding pipe coil 14 to the drum body 29.

Moreover, in some embodiments, the drum shaft 48 of a drum body 29 may be integrally formed with its drum core 28. However, in other embodiments, the drum shaft 48 and a drum core 28 of a drum body 29 may be implemented as separate components. In particular, in some such embodiments, the drum core 28 may include a shaft opening in which the drum shaft 48 is to be inserted and secured, for example, via a weldment, an adhesive, and/or a mechanical fastener.

In any case, a drum core 28 of a drum body 29 may generally have substantially fixed dimensions (e.g., geometry) and, thus, implemented using relatively rigid material, such as metal, a wood, a polymer, a composite, or any combination thereof. In fact, to facilitate fixing its dimensions, as in the depicted example, in some embodiments, the drum core 28 of a drum body 29 may generally be solid, for example, with the exception of forklift channels 50 that enable the drum body 29 to be moved via a forklift. On the other hand, a fluid bladder 30 of a drum body 29 may be implemented with a relatively flexible and/or elastic material. For example, a fluid bladder 30 of a drum body 29 may be implemented using a fabric, such as cotton or Kevlar, and/or a polymer, such as rubber. As such, supplying actuation fluid (e.g., liquid and/or gas) to the fluid bladder 30 may cause the fluid bladder 30 to expand whereas extracting actuation fluid from the fluid bladder 30 may cause the fluid bladder 30 to contract.

In other words, since implemented circumferentially around the drum core 28 of a drum body 29, extracting actuation fluid from the fluid bladder 30 may reduce the outer surface diameter of the drum body 29, for example, to enable the drum body 29 to be inserted into and/or withdrawn from the interior channel 24 of the pipe coil 14. On the other hand, supplying fluid to the fluid bladder 30 may increase the outer surface diameter of the drum body 29, for example, such that the outer surface of the drum body 29 engages (e.g., contacts) the inner surface of the pipe coil 14. In this manner, a pipe drum system 12 may be implemented and/or operated to facilitate supporting a pipe coil 14, for example, at least in part by blocking inward deflection (e.g., deformation) of the pipe coil 14.

In fact, in some embodiments, implementing and/or operating a pipe drum system 12 in accordance with the techniques of the present disclosure may enable the same drum body 29 to be selectively used with different pipe coils 14. In particular, as mentioned above, at least in some instances, different flexible pipes 10 may be formed into pipe coils 14 with differing dimensions. For example, a larger diameter flexible pipe 10 may have a larger minimum bend radius and, thus, formed into a pipe coil 14 with a larger interior channel diameter. On the other hand, a smaller diameter flexible pipe 10 may have a smaller minimum bend radius and, thus, formed into a pipe coil 14 with a smaller interior channel diameter.

Since the size of a fluid bladder 30 in a drum body 29 and, thus, the outer surface diameter of the drum body 29 varies with the amount of actuation fluid present in the fluid bladder 30, in some embodiments, a pipe drum system 12 may control the amount of actuation fluid supplied to the fluid bladder 30 based at least in part on the interior channel diameter of a pipe coil 14 to be supported by the drum body 29. For example, to support a pipe coil 14 with a larger interior channel diameter, the pipe drum system 12 may operate to supply a larger amount of actuation fluid to the fluid bladder 30. On the other hand, to support a pipe coil 14 with a smaller interior channel diameter, the pipe drum system 12 may operate to supply a smaller amount of actuation fluid to the fluid bladder 30. In this manner, a pipe drum system 12 may be implemented and/or operated to selectively support pipe coils 14 with differing dimensions, which, at least in some instances, may facilitate reducing implementation-associated cost (e.g., physical footprint and/or component count) of the pipe drum system 12, for example, by enabling the same drum body 29 to be used with multiple different pipe coils 14.

In any case, to facilitate supplying and/or extracting actuation fluid from the fluid bladder 30A, as depicted, the pipe drum system 12A additionally includes one or more fluid sources 32, for example, which include a fluid pump and/or a fluid valve. In particular, as depicted, the one or more fluid sources 32 are fluidly connected to a fluid port 36 of the fluid bladder 30 via one or more external fluid conduits 34, such as a hose. To facilitate controlling operation of the one or more fluid sources 32, as in the depicted example, in some embodiments, a pipe drum system 12 may additionally include a control sub-system 38. In fact, in some embodiments, the control sub-system 38 may be implemented and/or operated to autonomously control operation of the pipe drum system 12, for example, with little or no user intervention.

To facilitate controlling operation, as in the depicted example, in some embodiments, the control sub-system 38 may be communicatively coupled to one or more sensors 46. Generally, a sensor 46 in a pipe drum system 12 may be implemented and/or operated to determine sensor data indicative of one or more operational parameters of the pipe drum system 12, which may be communicated to a control sub-system 38 in the pipe drum system 12 via one or more sensor signals. For example, a pressure sensor 46 may determine sensor data indicative of fluid pressure being supplied to a fluid bladder 30 in a drum body 29. Additionally or alternatively, a sensor 46 may determine sensor data indicative of one or more other operational parameters, such as the force a fluid bladder 30 of the drum body 29 exerts on a corresponding pipe coil 14 and/or the gap distance between the fluid bladder 30 of the drum body 29 and the inner surface of the pipe coil 14.

In any case, to facilitate controlling operation of a pipe drum system 12, as in the depicted example, the control sub-system 38 may include one or more processors 40, memory 42, and one or more input/output (I/O) devices 44. In some embodiments, the memory 42 in the control sub-system 38 may include one or more tangible, non-transitory, computer-readable media that are implemented and/or operated to store data and/or executable instructions. For example, the memory 42 may store sensor data based at least in part on one or more sensor signals received from a sensor 46. As such, in some embodiments, the memory 42 may include volatile memory, such as random-access memory (RAM), and/or non-volatile memory, such as read-only memory (ROM), flash memory, a solid-state drive (SSD), a hard disc drive (HDD), or any combination thereof.

Additionally, in some embodiments, a processor 40 in the control sub-system 38 may include processing circuitry that is implemented and/or operated to process data and/or to execute instructions stored in memory 42. In other words, in some such embodiments, a processor 40 in the control sub-system 38 may include one or more general purpose microprocessors, one or more application specific integrated circuits (ASICs), one or more field programmable gate arrays (FPGAs), or any combination thereof. For example, a processor 40 in the control sub-system 38 may process sensor data that is determined by a pressure sensor 46 to determine the amount of actuation fluid present in a corresponding fluid bladder 30 of a drum body 29 and, thus, the outer surface diameter of the drum body 29.

Additionally or alternatively, a processor 40 in the control sub-system 38 may execute instructions stored in memory 42 to determine one or more control (e.g., command) signals that instruct the pipe drum system 12 to perform corresponding control actions. For example, the control sub-system 38 may determine a control signal that instructs a fluid source 32 to supply actuation fluid to a fluid bladder 30 in a drum body 29. Additionally or alternatively, the control sub-system 38 may determine a control signal that instructs a fluid source 32 to extract actuation fluid from within the fluid bladder 30 in the drum body 29.

Additionally, in some embodiments, a processor 40 in the control sub-system 38 may include processing circuitry that is implemented and/or operated to process data and/or to execute instructions stored in memory 42. In other words, in some such embodiments, a processor 40 in the control sub-system 38 may include one or more general purpose microprocessors, one or more application specific integrated circuits (ASICs), one or more field programmable gate arrays (FPGAs), or any combination thereof. For example, a processor 40 in the control sub-system 38 may process sensor data that is determined by a pressure sensor 46 to determine the amount of actuation fluid present in a corresponding fluid bladder 30 of a drum body 29 and, thus, the outer surface diameter of the drum body 29.

Additionally or alternatively, a processor 40 in the control sub-system 38 may execute instructions stored in memory 42 to determine one or more control (e.g., command) signals that instruct the pipe drum system 12 to perform corresponding control actions. For example, the control sub-system 38 may determine a control signal that instructs a fluid source 32 to supply actuation fluid to a fluid bladder 30 in a drum body 29. Additionally or alternatively, the control sub-system 38 may determine a control signal that instructs a fluid source 32 to extract actuation fluid from within the fluid bladder 30 in the drum body 29.

As another example, the control sub-system 38 may output a control signal that instructs a fluid source 32 to remove actuation fluid from within a fluid bladder 30 of a drum body 29 to set the fluid bladder 30 in a first (e.g., a deflated) state so as to enable the drum body 29 to be easily positioned within the interior channel 24 of a pipe coil 14. However, there may be gaps between the drum body 29 and the pipe coil 14 (e.g., between the fluid bladder 30 and inner surface of pipe coil 14) while the fluid bladder 30 is in the first state. Thus, the control sub-system 38 may output another control signal to the fluid source 32 that instructs the fluid source 32 to supply actuation fluid into the fluid bladder 30 so as to expand the fluid bladder 30 to a second (e.g., inflated) state. In the second state, the fluid bladder 30 may have an increased volume relative to that its first state and, thus, the gaps between the drum body 29 and the pipe coil 14 are substantially reduced while the fluid bladder 30 is in the second state. By way of example, when transitioning from the first state to the second state, the fluid bladder 30 may expand up to (e.g., in a radial direction) 5 centimeters (2 inches), 7.6 centimeters (3 inches), 10 centimeters (4 inches), 15.2 centimeters (6 inches), 30 centimeters (1 foot), or another suitable distance such that the fluid bladder 30 abuts a majority of the pipe coil 14 in the second state and, thus, supports the pipe coil 14.

In any case, to enable communication outside of the control sub-system 38, in some embodiments, the I/O devices 44 of the control sub-system 38 may include one or more input/output (I/O) ports (e.g., terminals). Additionally, to facilitate communicating operational status of a pipe drum system 12 to a user (e.g., operator or service technician), in some embodiments, the I/O devices 44 of the control sub-system 38 may include one or more user output devices, such as an electronic display, which is implemented and/or operated to display a graphical user interface (GUI) that provides a visual representation of one or more operational parameters of the pipe drum system 12. Furthermore, to enable user interaction with a pipe drum system 12, in some embodiments, the I/O devices 44 of the control sub-system 38 may include one or more user input devices, such as a hard button, a soft button, a keyboard, a mouse, and/or the like. For example, after a drum body 29 is inserted into the interior channel 24 of a pipe coil 15, the user may transmit a user input that instructs a fluid source 32 to supply actuation fluid to a fluid bladder 30 in the drum body 29 (e.g., to transition the fluid bladder 30 from the first state to the second state).

However, it again should be appreciated that the depicted example is merely intended to be illustrative and not limiting. In particular, in other embodiments, a pipe drum system 12 may not include a control sub-system 38 and/or sensors 46, for example, when operation of the pipe drum system 12 is to be manually controlled. Additionally, in other embodiments, a fluid bladder 30 of a drum body 29 included in a pipe drum system 12 may be implemented with a different configuration. To help illustrate, additional examples of pipe drum systems 12 are shown in FIGS. 2-6.

Figure 2:
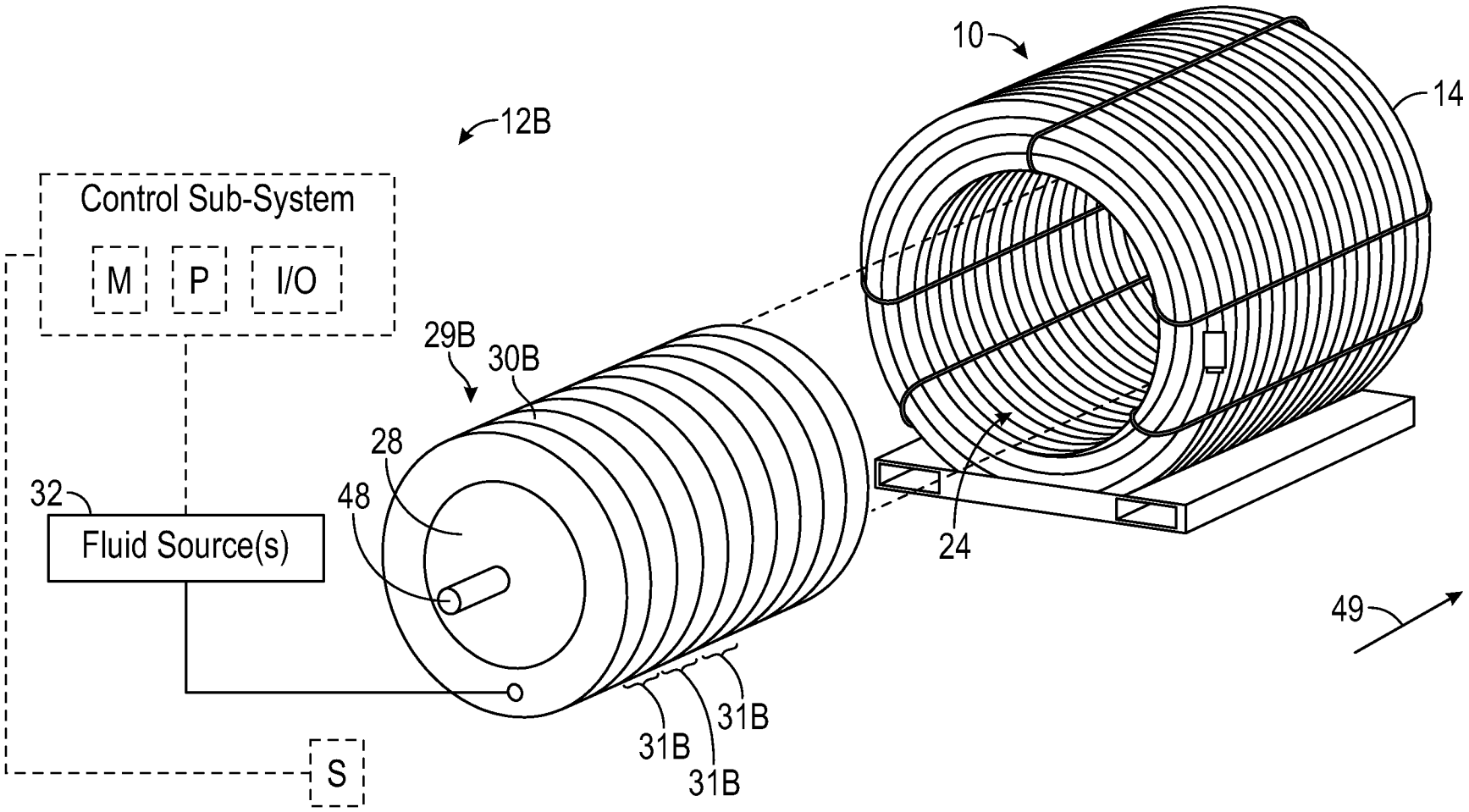
FIG. 2 is a perspective view of a pipe coil and another example of a pipe drum system, which includes multiple fluid bladders that are offset on a drum core along a longitudinal direction, in accordance with an embodiment of the present disclosure.

In particular, a flexible pipe 10, which is formed into a pipe coil 14, and another example of a pipe drum system 12B, which includes a drum body 29B with multiple fluid bladder loops 31B offset in an axial direction 49, are shown in FIG. 2. In certain embodiments, the multiple fluid bladder loops 31 may be implemented using a single fluid bladder 30B. For instance, the fluid bladder 30B may be helically wrapped around the drum core 28 to form the fluid bladder loops 31. In such embodiments, in the second (e.g., inflated) state, each fluid bladder loop 31 may have substantially the same, expanded size such that different fluid bladder loops 31 along the axial direction 49 provide substantially the same amount of support to the pipe coil 14.

However, in other embodiments, the multiple fluid bladder loops 31 of the drum body 29B may be implemented using multiple fluid bladders 30B that are circumferentially wrapped around the drum core 28 such that they are adjacent to one another. In such embodiments, each fluid bladder 30B may wrap around the drum core 28, for example, to form a single loop. Additionally, in some such embodiments, each of the multiple fluid bladders 30B may be separately coupled to the one or more fluid sources 32 included in the pipe drum system 12B. In particular, implementing multiple fluid bladder loops 31 in this manner may enable the amount of actuation fluid supplied to each fluid bladder 30 to be independently controlled. In other words, in such embodiments, the drum body 29B may be operated to provide varying support for the pipe coil 14 in the axial direction 49, for example, to facilitate accommodating nonuniformities (e.g., irregularities) in the shape of the interior channel 24 of the pipe coil 14 and, thus, the inner surface diameter of the pipe coil 14 in the axial direction 49.

However, it should be appreciated that the depicted example is merely intended to be illustrative and not limiting. In particular, as mentioned above, in other embodiments, a fluid bladder 30 of a drum body 29 included in a pipe drum system 12 may be implemented with a different configuration. For example, in some other embodiments, a drum body 29 may include multiple fluid bladders 30 arranged in a honeycomb or quilted arrangement (e.g., pattern).

Figure 3:
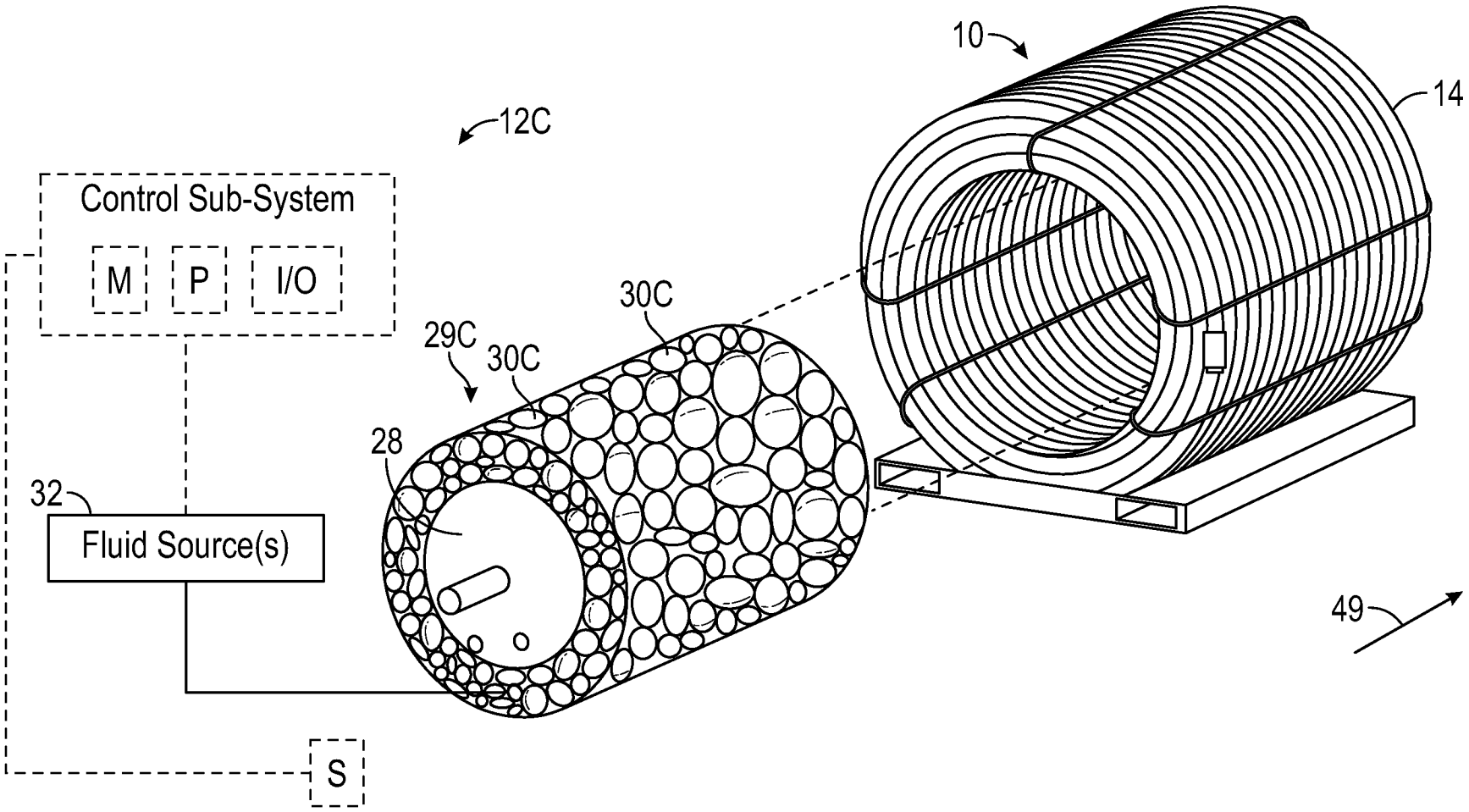
FIG. 3 is a perspective view of a pipe coil and another example of a pipe drum system, which includes multiple fluid bladders implemented in a honeycomb or quilted arrangement around a drum core, in accordance with an embodiment of the present disclosure.

To help illustrate, a flexible pipe 10, which is formed into a pipe coil 14, and another example of a pipe drum system 12C, which includes a drum body 29C with multiple fluid bladders 30C implemented in a honeycomb or quilted arrangement offset in an axial direction 49, are shown in FIG. 3. In particular, as depicted, the fluid bladders 30C are positioned circumferentially about the drum core 28 in an axial direction 49. In some embodiments, the fluid bladders 30C may be secured to the drum core 28 and/or to one another, for example, via an adhesive.

Additionally, in some embodiments, each of the multiple fluid bladders 30C may be separately coupled to the one or more fluid sources 32 in the pipe drum system 12C. In particular, implementing multiple fluid bladders 30C in this manner may enable the amount of actuation fluid supplied to each fluid bladder 30C to be independently controlled. In fact, in such embodiments, if the amount of fluid in one of the fluid bladders 30 is not easily controllable (e.g., due to a leak), the amount of actuation fluid supplied to the remaining fluid bladders 30 may be controlled to provide sufficient support for the pipe coil 14, which, at least in some instances, may facilitate improving operational reliability of a pipe drum system 12.

However, it should be appreciated that the depicted example is merely intended to be illustrative and not limiting. In particular, as mentioned above, in other embodiments, a fluid bladder 30 of a drum body 29 included in a pipe drum system 12 may be implemented with a different configuration. For example, although a single fluid bladder layer is depicted, in some other embodiments, a drum body 29 may include multiple fluid bladder layers that are radially offset from one another.

Figure 4:
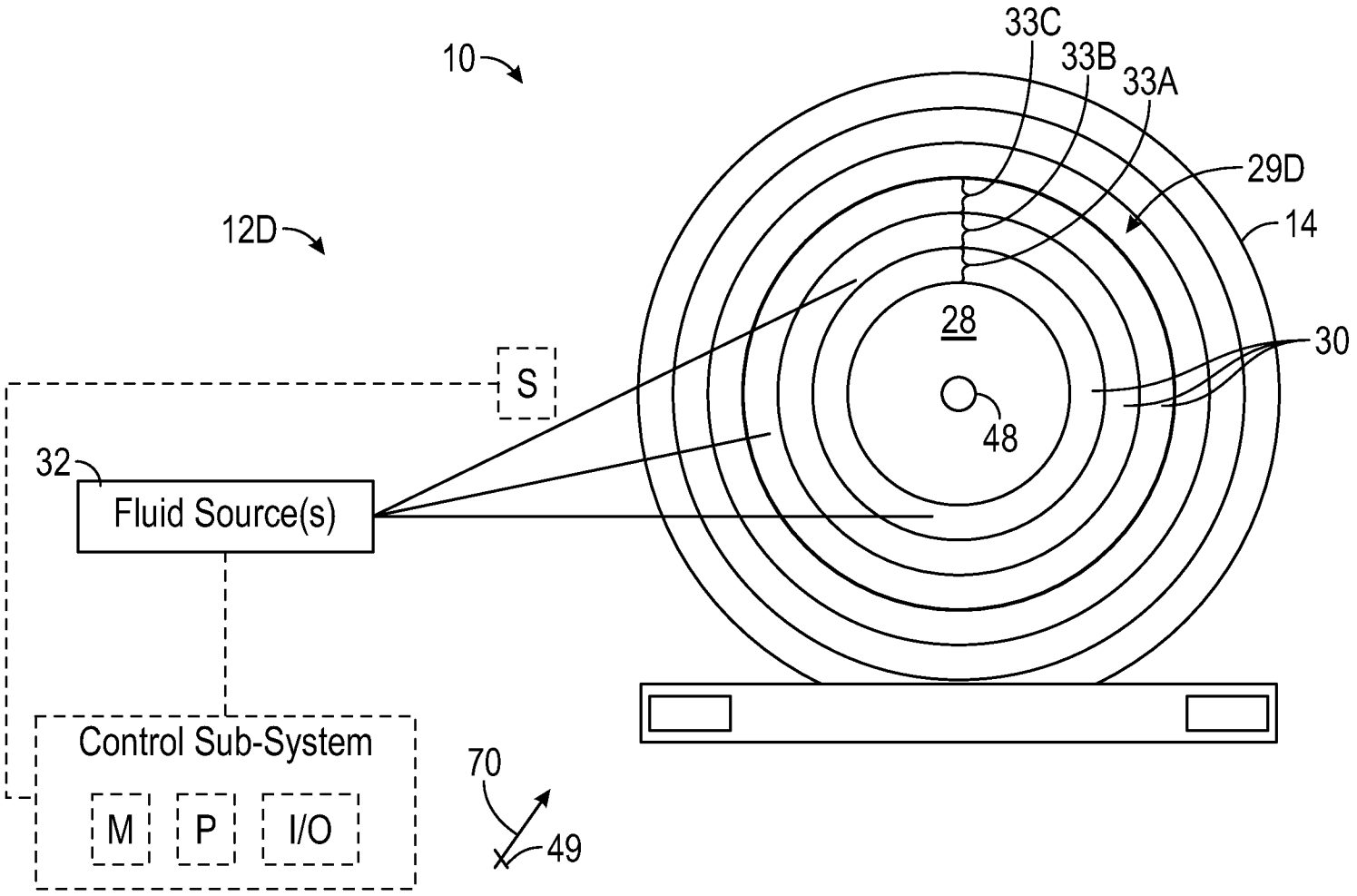
FIG. 4 is a side view of a pipe coil and another example of a pipe drum system, which includes multiple layers of fluid bladders that are offset in a radial direction around a drum core, in accordance with an embodiment of the present disclosure.

To help illustrate, a flexible pipe 10, which is formed into a pipe coil 14, and another example of a pipe drum system 12D, which includes a drum body 29D with multiple fluid bladder layers 33 that are offset from one another in a radial direction 70, are shown in FIG. 4. In some embodiments, the multiple fluid bladder layers 33 may be implemented using a single fluid bladder 30. For in such embodiments, the fluid bladder 30 may wrap around the drum core 28 in a spiral manner to stack multiple fluid bladder layers 33 atop one another along the radial direction 70.

However, in other embodiments, different fluid bladder layers 33 may include different fluid bladders 30. In particular, similar to FIG. 1, in some such embodiments, one or more fluid bladder layers 33 of the drum body 29D in FIG. 4 may be implemented using a single continuous fluid bladder 30D. Additionally or alternatively, similar to FIG. 2, one or more fluid bladder layers 33 of the drum body 29D in FIG. 4 may be implemented using multiple fluid bladder loops 31 that are offset in an axial direction 49 along the drum body 29D. Furthermore, similar to FIG. 3, in some such embodiments, one or more fluid bladder layers 33 of the drum body 29D in FIG. 4 may be implemented using multiple fluid bladders 30D arranged in a honeycomb or quilted arrangement.

In any case, at least in some instances, implementing different fluid bladder layers 33 using different fluid bladders 30 may facilitate increasing the number of different pipe coil inner surface diameters a drum body 29 can accommodate. For example, to support a pipe coil 14 with a smaller inner surface diameter, the pipe drum system 12D may transition a first (e.g., inner) fluid bladder layer 33A and a second (e.g., intermediate) fluid bladder layer 33B to their second (e.g., inflated) states while maintaining a third (e.g., outer) fluid bladder layer 33C in its first (e.g., deflated) state. However, to support a pipe coil 14 with a larger inner surface diameter, the pipe drum system 12D may transition the first fluid bladder layer 33A and the second fluid bladder layer 33B as well as the third fluid bladder layer 33C to their second (e.g., inflated) states.

Moreover, in some embodiments, each of the multiple fluid bladder layers 33 may be separately coupled to the one or more fluid sources 32 in the pipe drum system 12D. In particular, implementing multiple fluid bladder layer 33 in this manner may enable the amount of actuation fluid supplied to each fluid bladder layer 33 to be independently controlled. In fact, in such embodiments, if the amount of fluid in one of the fluid bladder layers 33 is not easily controllable (e.g., due to a leak), the amount of actuation fluid supplied to the remaining fluid bladder layers 33 may be controlled to provide sufficient support for the pipe coil 14, which, at least in some instances, may facilitate improving operational reliability of a pipe drum system 12. For example, when a leak is present in the third fluid bladder layer 33C, extra actuation fluid may be supplied to the first fluid bladder layer 33A and the second fluid bladder layer 33B to account for the drum body outer surface diameter expansion that would otherwise be provided by the third fluid bladder layer 33C.

However, it should be appreciated that the depicted example is merely intended to be illustrative and not limiting. In particular, in other embodiments, a drum body 29 may include more than three (e.g., four, five, or more) fluid bladder layers 33 or fewer than two (e.g., one or two) fluid bladder layers 33. Additionally, in other embodiments, the fluid bladder layers 33 of a drum body 29 not be evenly distributed about the drum core 28. For example, in such embodiments, the fluid bladder layers 33 may be implemented to have a thicker layer on one side of the drum core 28 and a thinner layer an opposite side of the drum core 28. In other words, in such embodiments, the drum core 28 and, thus, its drum shaft may be offset from a center of the interior channel 24 of a corresponding pipe coil 14. Furthermore, in other embodiments, a drum body 29 may be implemented such that its outermost fluid bladder layer 33 does not directly contact the inner surface of a pipe coil 14.

Figure 5:
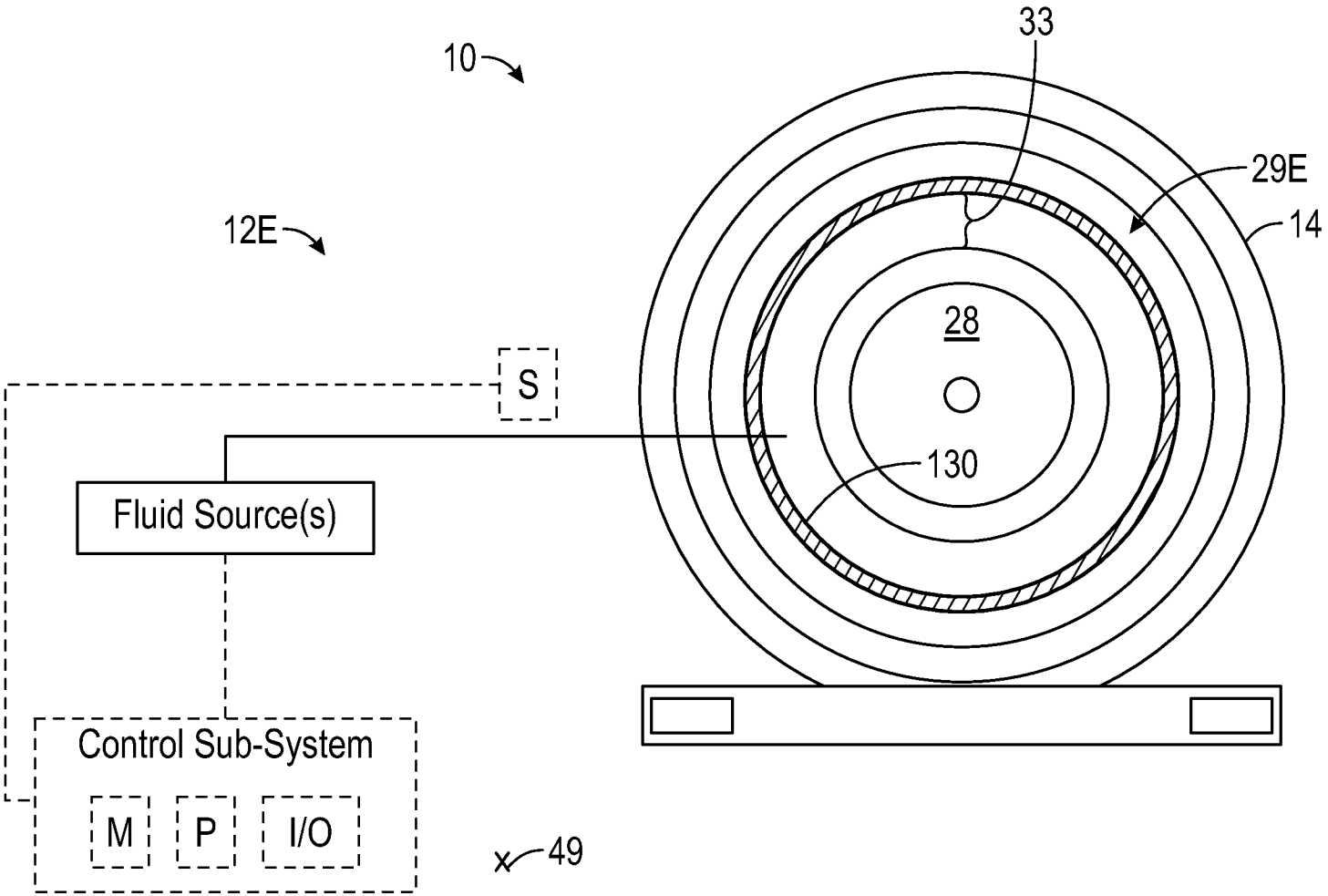
FIG. 5 is a side view of a pipe coil and another example of a pipe drum system, which includes a cover that covers a fluid bladder, in accordance with an embodiment of the present disclosure.

To help illustrate, a flexible pipe 10, which is formed into a pipe coil 14, and another example of a pipe drum system 12E, which includes a drum body 29E with a cover layer 130 implemented circumferentially around its one or more fluid bladder layers 33, are shown in FIG. 5. In particular, as depicted, the cover layer 130 is disposed between the one or more fluid bladder layers 33 of the drum body 29E and the inner surface of the pipe coil 14. As such, the cover layer 130 may facilitate shielding the one or more fluid bladder layers 33 of the drum body 29E, for example, at least in part by block features (e.g., debris) from contacting and, thus, potentially puncturing the one or more fluid bladder layers 33. Additionally or alternatively, the cover layer 130 may facilitate absorbing force exerted on the drum body 29E by the pipe coil 14 or vice versa.

In any case, since implemented around the one or more fluid bladder layers 33, to enable the outer surface diameter to be adaptively adjusted, the cover layer may be implemented at least in part using flexible and/or elastic material, such as rubber. Nevertheless, in some embodiments, the cover layer 130 of a drum body 29 may additionally include solid structures, such as beams and/or additional piping. For example, in some such embodiments, the cover layer 130 may include multiple beams that extend in an axial direction 49 along the drum body 29 and rubber connected between adjacent beams.

However, it should be appreciated that the depicted example is merely intended to be illustrative and not limiting. In particular, in some embodiments, the cover layer 130 may extend over the ends of the one or more fluid bladder layers 33, for example, to facilitate further shielding the one or more fluid bladder layers 33. Additionally or alternatively, in other embodiments, a drum core 28 of a drum body 29 may be implemented as a frame, for example, instead of a solid component.

Figure 6:
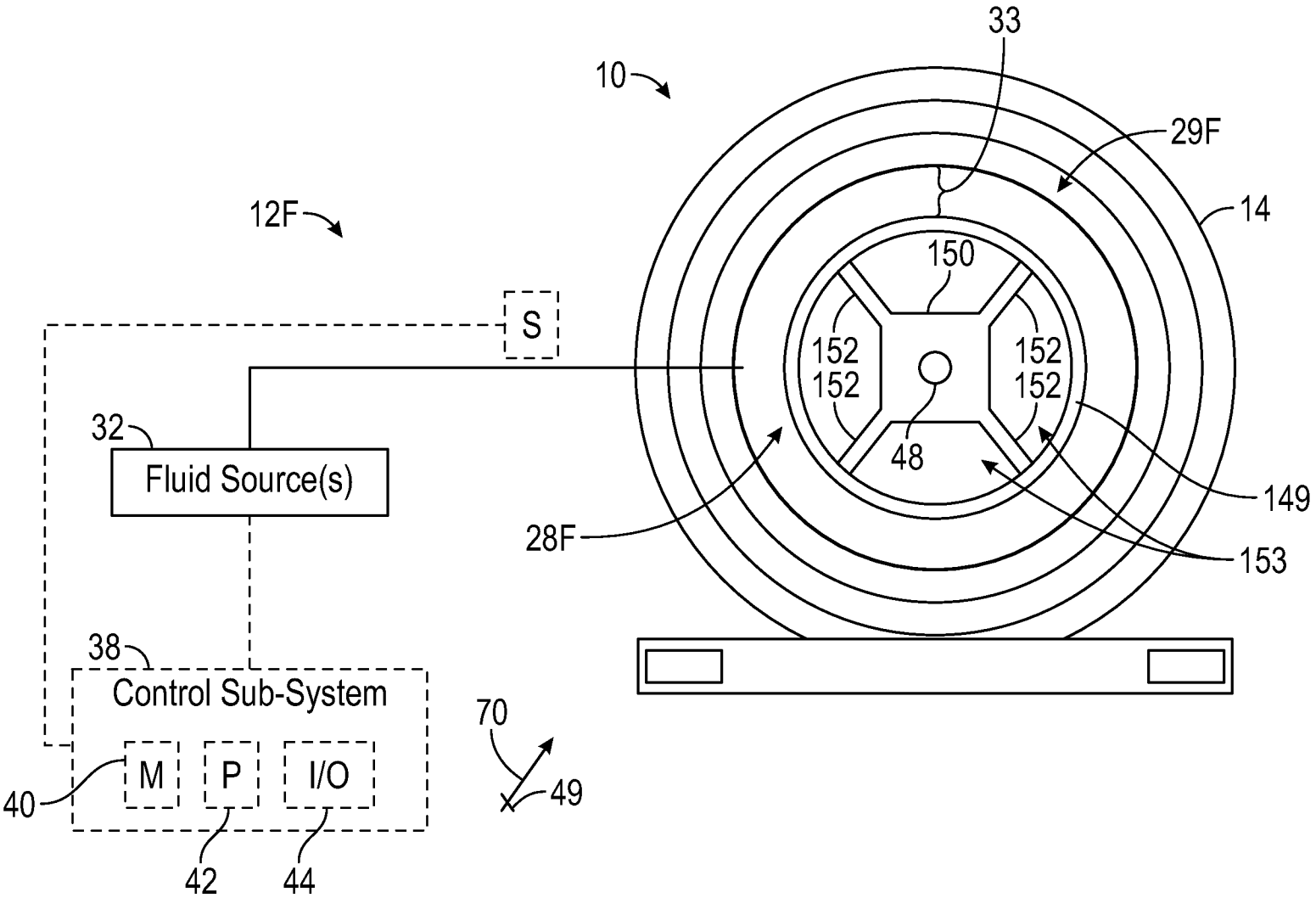
FIG. 6 is a side view of a pipe coil and another example of a pipe drum system, which includes a frame-like drum bore, in accordance with an embodiment of the present disclosure.

To help illustrate, a flexible pipe 10, which is formed into a pipe coil 14, and another example of a pipe drum system 12F, which includes a drum body 29F with a frame drum core 28F, are shown in FIG. 6. As depicted, one or more fluid bladder layers 33 of the drum body 29F are implemented circumferentially around a rim 149 of the frame drum core 28F. In addition to the rim 149, as depicted, the frame drum core 28F includes a base 150, a drum shaft 48 that extends out from the base 150, and multiple spokes 152 that are secured between the rim 149 and the base 150.

In particular, as in the depicted example, implementing the drum core 28 of a drum body 29 as a frame may result in open space 153 being present within the drum core 28. Thus, as compared to the drum core 28A of FIG. 1, at least in some instances, the frame drum core 28F may be implemented using less material and, thus, weigh less while nevertheless providing sufficient support to the one or more fluid bladder layers 33. In other words, at least in some instances, implementing the drum core 28 of a drum body 29 as a frame may facilitate improving the ease with which the drum body 29 can be moved.

However, it should be appreciated that the depicted example is merely intended to be illustrative and not limiting. In particular, in other embodiments, the base 150 of a drum core 28 may be implemented with a non-rectangular shape, such as a circular shape. Additionally or alternatively, in other embodiments, a drum core 28 of a drum body 29 may include more than four (e.g., five, six, or more) spokes 152 or fewer than four (e.g., three or two) spokes 152.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principals of the disclosure and its practical applications, to thereby enable others skilled in the art to best utilize the disclosure and various embodiments with various modifications as are suited to the particular use contemplated.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A pipe drum system comprising a drum body, wherein:
the drum body is configured to be disposed within an interior channel of a pipe coil that is formed from a flexible pipe comprising tubing that defines a pipe bore and a fluid conduit within an annulus of the tubing; and
the drum body comprises:
a drum core implemented with substantially fixed dimensions; and
a fluid bladder layer implemented circumferentially around the drum core, wherein the pipe drum system is configured to:
maintain the fluid bladder layer in a first state to enable the drum body to be inserted into the interior channel of the pipe coil after the pipe coil is formed; and
increase inflation of the fluid bladder layer from the first state to a second state to enable an outer surface of the drum body to push against an inner surface of the pipe coil to facilitate supporting the pipe coil.

2. The pipe drum system of claim 1, wherein the fluid bladder layer of the drum body comprises a fluid bladder helically wrapped in an axial direction along the drum core of the drum body.

3. The pipe drum system of claim 1, wherein the fluid bladder layer of the drum body comprises:
a first fluid bladder wrapped circumferentially around the drum core; and
a second fluid bladder wrapped circumferentially around the drum core such that the second fluid bladder is adjacent to the first fluid bladder in an axial direction along the drum core.

4. The pipe drum system of claim 3, wherein the pipe drum system is configured to supply more actuation fluid to the first fluid bladder than the second fluid bladder to facilitate accommodating nonuniformity in shape of the interior channel of the pipe coil along the axial direction.

5. The pipe drum system of claim 1, wherein the fluid bladder layer of the drum body comprises a plurality of fluid bladders arranged in a honeycomb or quilted arrangement.

6. The pipe drum system of claim 1, comprising:
one or more fluid sources fluidly coupled to the fluid bladder layer of the drum body via one or more external fluid conduits; and
a control sub-system communicatively coupled to the one or more fluid sources, wherein the control sub-system is configured to selectively instruct the one or more fluid sources to supply actuation fluid to the fluid bladder layer, to extract actuation fluid from the fluid bladder layer, or both.

7. The pipe drum system of claim 1, wherein the drum body comprises another fluid bladder layer implemented circumferentially around the fluid bladder layer, wherein the pipe drum system is configured to:

maintain the other fluid bladder layer in the first state to enable the drum body to be inserted into the interior channel of the pipe coil after the pipe coil is formed; and increase inflation of the other fluid bladder layer from the first state to the second state to enable the outer surface of the drum body to push against the inner surface of the pipe coil to facilitate supporting the pipe coil.

8. The pipe drum system of claim 7, wherein the pipe drum system is configured to increase inflation of the fluid bladder layer from the first state to the second state while maintaining inflation of the other fluid bladder layer in the second state when the drum body is disposed within another pipe coil that has a smaller inner surface diameter than the pipe coil.

9. A method of implementing a pipe drum system, comprising:

implementing a drum core of a drum body in the pipe drum system that is to be disposed within an interior channel of a pipe coil such that the drum core has substantially fixed dimensions;

securing a drum shaft to the drum core of the drum body such that the drum shaft extends out from the drum core; and securing a plurality of fluid bladders circumferentially around the drum core of the drum body to enable:

the drum body to be inserted into the interior channel of the pipe coil at least in part by maintaining the plurality of fluid bladders in a deflated state; and the drum body to be secured to the pipe coil at least in part by transitioning the plurality of fluid bladders from the deflated state to an inflated state to enable flexible pipe to be deployed from the pipe coil at least in part by rotating the drum body about the drum shaft.

10. The method of claim 9, wherein securing the plurality of fluid bladders circumferentially around the drum core comprises:

wrapping a first fluid bladder around the drum core to form a first fluid bladder loop; and wrapping a second fluid bladder around the drum core to form a second fluid bladder loop that is adjacent to the first fluid bladder loop in an axial direction along the drum core.

11. The method of claim 10, comprising:

fluidly coupling the first fluid bladder to one or more fluid sources in the pipe drum system via a first one or more external fluid conduits; and fluidly coupling the second fluid bladder to the one or more fluid sources in the pipe drum system via a second one or more external fluid conduits.

12. The method of claim 9, wherein securing the plurality of fluid bladders circumferentially around the drum core comprises securing the plurality of fluid bladders circumferentially around the drum core in a honeycomb or quilted arrangement.

13. The method of claim 9, wherein securing the plurality of fluid bladders circumferentially around the drum core comprises:

securing a first fluid bladder directly on the drum core; and securing a second fluid bladder over the first fluid bladder.

14. The method of claim 9, wherein implementing the drum core of the drum body comprises:

forming a rim, wherein securing the plurality of fluid bladders circumferentially around the drum core comprises securing the plurality of fluid bladders circumferentially around the rim of the drum core;

forming a base, wherein securing the drum shaft to the drum core comprises securing the drum shaft to the base of the drum core; and securing a plurality of spokes between the rim and the base.

15. A drum body comprising:

a drum core implemented to have a substantially fixed geometry;

a drum shaft that extends out from the drum core to enable flexible pipe to be deployed from a pipe coil that is secured to the drum body at least in part by rotating the drum body about the drum shaft; and a plurality of fluid bladders secured circumferentially around the drum core, wherein the plurality of fluid bladders is configured to:

contract an outer surface diameter of the drum body inwardly as the plurality of fluid bladders is transitioned from an inflated state to a deflated state to enable the drum body to be inserted into an interior channel of the pipe coil; and expand the outer surface diameter of the drum body outwardly as the plurality of fluid bladders is transitioned from the deflated state to the inflated state to facilitate securing the drum body to the pipe coil.

16. The drum body of claim 15, wherein the drum core comprises:

a rim, wherein the plurality of fluid bladders is secured circumferentially around the rim of the drum core;

a base, wherein the drum shaft extends out from the base; and a plurality of spokes secured between the rim and the base of the drum core.

17. The drum body of claim 15, wherein the plurality of fluid bladders comprises:

a first fluid bladder that is wrapped circumferentially around the drum body to form a first fluid bladder loop; and a second fluid bladder that is wrapped circumferentially around the drum body to form a second fluid bladder loop that is adjacent to the first fluid bladder loop in an axial direction along the drum core.

18. The drum body of claim 15, wherein the plurality of fluid bladders comprises:

a first fluid bladder secured directly on the drum body; and a second fluid bladder secured over the first fluid bladder.

19. The drum body of claim 15, comprising a cover layer disposed over the plurality of fluid bladders.

* * * * *